US011498331B2

(12) United States Patent
Yaginuma

(10) Patent No.: US 11,498,331 B2
(45) Date of Patent: Nov. 15, 2022

(54) LIQUID EJECTION HEAD

(71) Applicant: CANON KABUSHIKI KAISHA, Tokyo (JP)

(72) Inventor: Seiichiro Yaginuma, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 95 days.

(21) Appl. No.: 17/069,440

(22) Filed: Oct. 13, 2020

(65) Prior Publication Data

US 2021/0114372 A1 Apr. 22, 2021

(30) Foreign Application Priority Data

Oct. 18, 2019 (JP) ..... JP2019-191392

(51) Int. Cl.
*B41J 2/18* (2006.01)
*B41J 2/14* (2006.01)
*B41J 2/17* (2006.01)

(52) U.S. Cl.
CPC . *B41J 2/14* (2013.01); *B41J 2/17* (2013.01); *B41J 2/18* (2013.01)

(58) Field of Classification Search
CPC ..... B41J 2202/12; B41J 2/14; B41J 2/18
See application file for complete search history.

(56) References Cited

U.S. PATENT DOCUMENTS

2015/0273853 A1* 10/2015 Govyadinov ..... B41J 2/14201 347/89

FOREIGN PATENT DOCUMENTS

WO 2012008978 A1 1/2012

* cited by examiner

*Primary Examiner* — Scott A Richmond
(74) *Attorney, Agent, or Firm* — Canon U.S.A., Inc. I.P. Division

(57) ABSTRACT

A liquid ejection head including a liquid distribution path with a first liquid circulation flow path that is branched from the liquid distribution path and a second liquid circulation flow path joined to the liquid distribution path. A flow path wall sections the first and second liquid circulation flow paths and an ejection orifice is provided in each of the second liquid circulation flow path. Energy generating elements and liquid circulating elements are provided in each of the first and second liquid circulation flow paths. A structure is provided on an extension line of a center line of the first flow path wall and is placed at a position at which the structure overlaps the liquid distribution path.

11 Claims, 7 Drawing Sheets

LIQUID EJECTION HEAD

BACKGROUND

Field of the Disclosure

The present disclosure relates to a liquid ejection head.

Description of the Related Art

A recording apparatus such as an ink jet printer has a liquid ejection head that ejects liquid. A liquid ejection head disclosed in International Publication No. WO2012-008978 is configured such that a plurality of droplet generators is placed at equal intervals and liquid from a fluid slot is supplied to the droplet generator using a fluid pump. The droplet generator generates energy in accordance with a supplied electric signal, and the droplets are ejected from a selected ejection orifice.

In the liquid ejection head disclosed in International Publication No. WO2012-008978, there is a possibility that "crosstalk" occurs if the droplet generator corresponding to an energy generating elements are driven. The crosstalk is a phenomenon that a flow of a flow path in which driven energy generating elements are placed affects a flow of an adjacent flow path via a common supply flow path and may be one of the factors that degrades the quality of printed products. When a liquid circulating element that is provided in a flow path and that generates energy for circulating the liquid through the flow path is driven, a phenomenon that the flow of the liquid in the flow path affects a flow in the adjacent flow path via the common supply flow path may also occur. The liquid circulating element is controlled such that a flow inside the flow path in which the liquid circulating element itself is provided is an optimal flow. However, there is a case in which the flows in the corresponding flow path and the adjacent flow path become undesired flows if crosstalk occurs and the liquid to be flowed into the adjacent flow path flows into the corresponding flow path. If this happens, there is a possibility that an unnecessarily large amount of liquid is ejected from the ejection orifice of the corresponding flow path, an ejection direction of the ejected liquid changes, or a necessary flow amount of liquid is not supplied to the adjacent flow path which might lead to an increase in viscosity.

SUMMARY

According to an aspect of the present disclosure, there is provided a liquid ejection head including a liquid distribution path through which a liquid is distributed, a first liquid circulation flow path that is branched from the liquid distribution path and a second liquid circulation flow path that is joined to the liquid distribution path, a first flow path wall that sections the first liquid circulation flow path and the second liquid circulation flow path, an ejection orifice, which is provided in the second liquid circulation flow path, from which the liquid is ejected, an energy generating element that is provided in the second liquid circulation flow path and generates energy for ejecting the liquid from the ejection orifice, a liquid circulating element that is provided in the first liquid circulation flow path and generates energy for circulating the liquid through the first and second liquid circulation flow paths; and a structure disposed so as to extend along a center line of the first flow path wall and is at a position at which the structure overlaps the liquid distribution path, wherein the first and second liquid circulation flow paths are joined with each other at a position downstream of the liquid circulating element and upstream of energy generating element.

Further features of the present disclosure will become apparent from the following description of exemplary embodiments with reference to the attached drawings.

DESCRIPTION OF THE EMBODIMENTS

First Embodiment

Figure 1A:
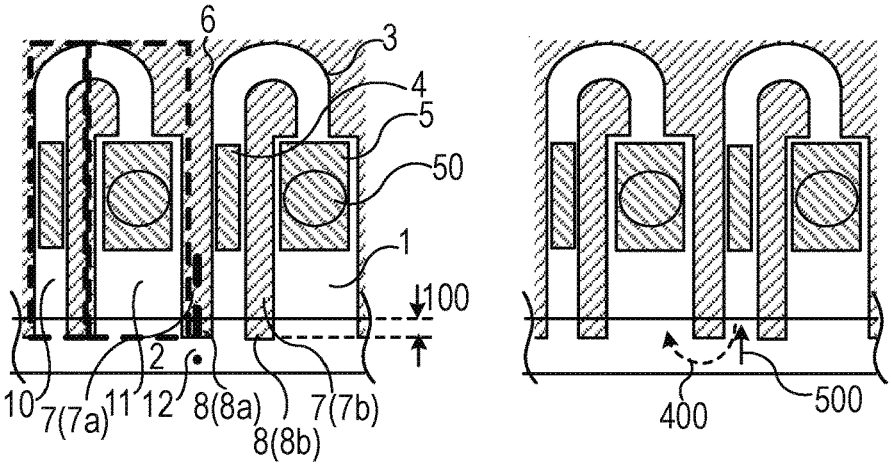
FIGS. 1A, 1B, 1C and 1D are diagrams illustrating a first embodiment of a liquid ejection head according to the present disclosure.

FIGS. 1A to 1D are diagrams illustrating a first embodiment of a liquid ejection head according to the present disclosure. As illustrated in the left-side diagram in FIG. 1A, a substrate 1 is provided with a liquid supply path 2, and a flow path wall member 6 is formed on the substrate 1, in a liquid ejection head. The flow path wall member 6 has a flow path wall 7 and a structure 8, and the flow path wall 7 forms a liquid circulation flow path 3. A liquid circulating element 4 and a liquid ejection energy generating element 5 are placed in the liquid circulation flow path 3. An ejection orifice 50 is provided at a position at which the ejection orifice 50 faces the liquid ejection energy generating element 5. The liquid is supplied from the liquid supply path and flows into the liquid circulation flow path 3.

The liquid supply path 2 is a liquid distribution path provided in the substrate 1 to supply the liquid ejected from the ejection orifice 50 (through which the liquid is distributed). The liquid supply path 2 extends in the thickness direction of the substrate 1. Although examples of the liquid include ink, the liquid is not limited thereto. The liquid circulation flow path 3 is a circulation flow path that is branched from the liquid supply path 2, communicates with the ejection orifice 50, and joins the liquid supply path 2. The liquid circulation flow path 3 is a flow path formed on the surface of the substrate 1. The liquid circulation flow path 3 extends in a direction that intersects the liquid supply path 2. Here, the liquid circulation flow path 3 and the liquid supply path 2 extend in mutually perpendicularly intersecting directions. The liquid circulation flow path 3 is a U-shaped flow path provided individually for each ejection orifice and is configured of a first portion 10 (the same applies to the following description) connected to a portion branched from the liquid supply path 2 and a second portion 11 (the same applies to the following description) connected to a portion joining the liquid supply path 2. The first portion 10 includes a liquid circulating element 4. The second portion 11 includes the liquid ejection energy generating element 5, and the liquid flows in a direction opposite to the first portion 10. The liquid circulating element 4 generates energy for circulating the liquid supplied from the liquid supply path 2 so as to flow from the portion branched from the liquid supply path 2 to the portion joining the liquid supply path 2 inside the liquid circulation flow path 3. The liquid ejection energy generating element 5 generates energy for ejecting the liquid from the ejection orifice 50. The ejection orifice 50 is an opening from which the liquid is ejected. As the liquid ejection energy generating element 5, a heater element, a piezoelectric element, or the like can be used. A heater element, a piezoelectric element, or the like can be used as the liquid circulating element 4 as well. The flow path wall 7 is configured of a first flow path wall 7*a* placed at a position at which the first flow path wall 7*a* sections the mutually adjacent liquid circulation flow path 3 and a second flow path wall 7*b* that sections the first portion 10 and the second portion 11.

The structure 8 is provided so as to protrude from the flow path wall 7 on an extension line 12 of a center line of the flow path wall 7. In the embodiment, the structure 8 is placed at a position at which the structure 8 overlaps the liquid supply path 2 when seen in a direction that perpendicularly intersects the substrate 1 (a direction that faces the ejection orifice 50). The structure 8 is an extension portion of the flow path wall 7 and is provided so as to be continued from the flow path wall 7. A structure 8 is placed on each of the first flow path wall 7*a* and the second flow path wall 7*b*. The structure 8 is a portion protruding to the liquid supply path 2, and the flow path wall 7 is a portion of the flow path wall member 6 except for the structure 8. Although the flow path wall 7 and the structure 8 may be formed of mutually different materials, the flow path wall 7 and the structure 8 are more preferably formed of the same type of materials since uniform internal stress and liquid affinity are obtained. The same type of materials mean materials formed of substantially the same composition except for minute differences caused by manufacturing errors and the like. The structure 8 can inhibit propagation of crosstalk, which is generated when the liquid circulating element 4 is driven, to the adjacent liquid circulation flow path 3.

A higher crosstalk inhibiting effect is achieved by setting the length 100 of the structure 8 in an extending direction from the liquid circulation flow path 3 to the liquid supply path 2 (the length by which the structure 8 protrudes; hereinafter, referred to as the length of the structure) to be longer. The length 100 is preferably 5 μm or more in consideration of a manufacturing error of the structure 8 and is preferably 10 μm or more such that influences of the manufacturing error of the structure 8 are relatively reduced and a uniform crosstalk inhibiting effect is achieved. Also, the length 100 is preferably longer than the minimum flow path width of the liquid circulation flow path 3 for inhibiting crosstalk. However, the length 100 is preferably 100 μm or less for avoiding an increase in the size of the liquid ejection head.

The right-side diagram in FIG. 1A illustrates a flow 400 that causes crosstalk when the liquid is circulated and a flow 500 that supplies the liquid to the liquid circulating element 4 when the liquid is circulated. As illustrated in the right-side diagram in FIG. 1A, the flow 400 that causes crosstalk is weakened by the presence of the structure 8. As a result, more liquid is supplied to the liquid circulating element 4 through the flow 500. Here, the structure extending from the first flow path wall 7*a* is defined as a first structure 8*a*, and the structure extending from the second flow path wall 7*b* is defined as a second structure 8*b*.

Figure 1B:
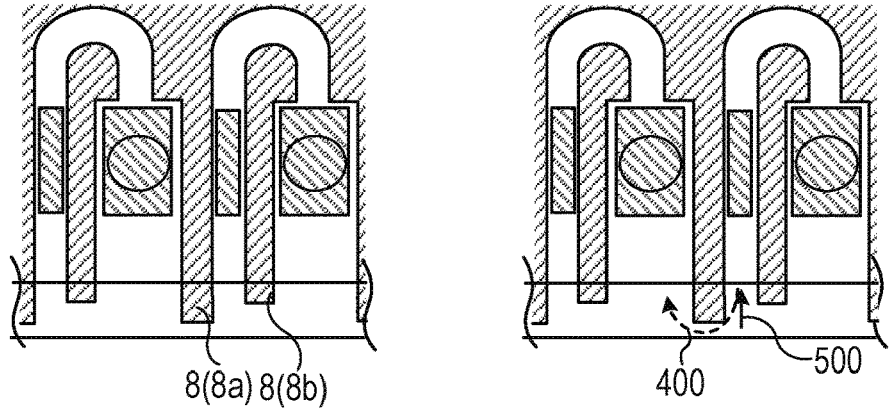

As illustrated in FIG. 1B, the first structure 8*a* may be longer than the second structure 8*b*. It is possible to achieve both inhibiting of crosstalk and liquid circulation efficiency by using such a structure 8 to promote the flowing of the liquid into the liquid circulating element 4 when the liquid is circulated. This is because the flow amount of the liquid (flow 500) supplied to the liquid circulating element 4 increases and the flow 400 into another liquid circulation flow path that is adjacent is inhibited, as compared with a case in which the structure 8 illustrated in FIG. 1A is used.

Figure 1C:
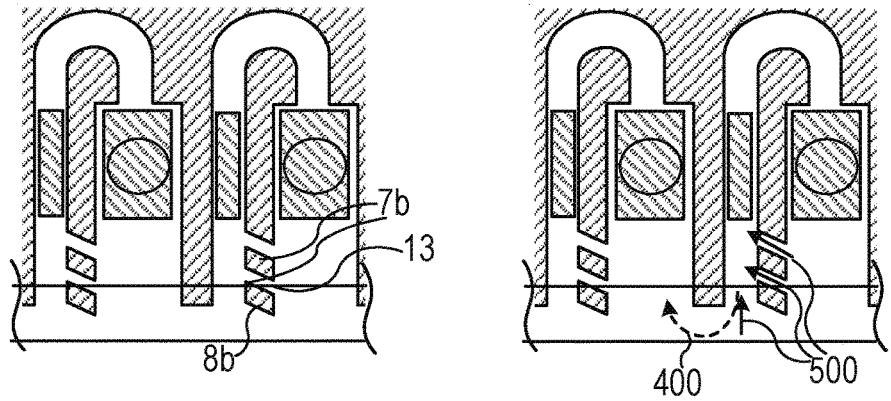

As illustrated in FIG. 1C, a slit 13 penetrating through the second flow path wall 7*b* and the second structure 8*b* may be formed between liquid circulation flow paths. The slit 13 is inclined from an end portion thereof facing the second portion 11 toward an end portion thereof facing the first portion 10 of the slit 13 so as to approach the liquid circulating element 4. Since the flowing of the liquid into the liquid circulating element 4 when the liquid is circulated is promoted, it is possible to achieve both the inhibiting of crosstalk and the liquid circulation efficiency. This is because the flow amount of the liquid supplied to the liquid circulating element 4 increases due to addition of the flow 500 via the slit 13 and the flow 400 into another liquid circulation flow path that is adjacent is inhibited, as compared with the case in which the structure 8 illustrated in FIG. 1A is used. Also, since the flow 500 generates a flow of the liquid from the liquid ejection energy generating element 5 toward the liquid supply path 2 of the first portion 10 when the liquid is circulated, the liquid circulation efficiency is improved. The slit may be formed in either the flow path wall 7 or the structure 8.

Figure 1D:
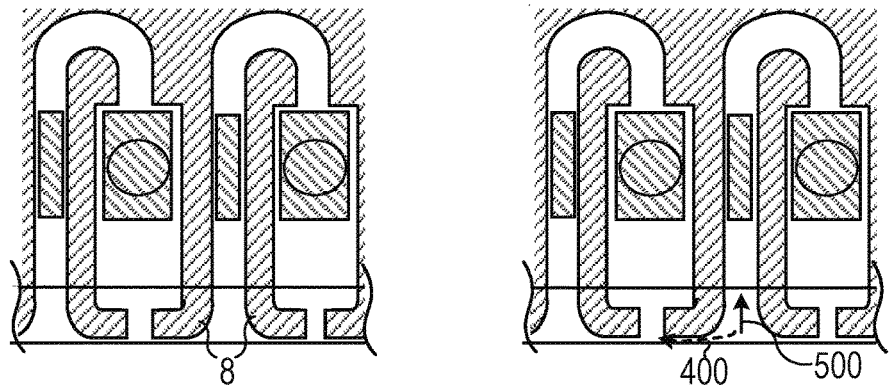

As illustrated in FIG. 1D, the structure 8 may be placed as an extension portion that is curved in a direction in which the liquid supply path 2 extends. The curved portion is curved in the direction of the liquid ejection energy generating element (second portion 11). A flow path on the front surface of the liquid ejection energy generating element 5 is narrowed by two mutually facing structures 8. As a result, the liquid is relatively likely to flow into the first portion 10 (flow 500) and is unlikely to flow into the second portion 11 of another liquid circulation flow path that is adjacent (flow 400). Therefore, crosstalk is unlikely to occur when the liquid is circulated as compared with the case in which the structure 8 illustrated in FIG. 1A is used.

Second Embodiment

Figure 2A:
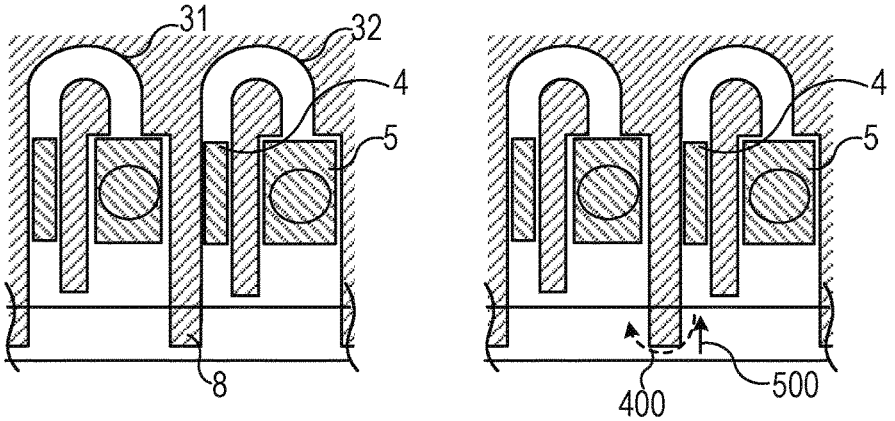
FIGS. 2A, 2B, 2C and 2D are diagrams illustrating a second embodiment of a liquid ejection head according to the present disclosure.

FIGS. 2A to 2D are diagrams illustrating a second embodiment of a liquid ejection head according to the present disclosure. As illustrated in FIG. 2A, the structure 8 may be placed only on the first flow path wall placed at a position at which the first flow path wall sections the liquid circulation flow path 31 and the liquid circulation flow path 32 that are adjacent to each other. Since the flowing of the liquid into the liquid circulating element 4 is promoted when the liquid is circulated in such a form, it is possible to achieve both the inhibiting of crosstalk and the liquid circulation efficiency. The flow amount (flow 500) of the liquid supplied to the liquid circulating element 4 increases, and the flow 400 into another liquid circulation flow path that is adjacent is inhibited, as compared with the case in which the structure 8 illustrated in FIG. 1A is used. Also, refilling properties of the liquid ejection energy generating element 5 is also improved.

Figure 2B:
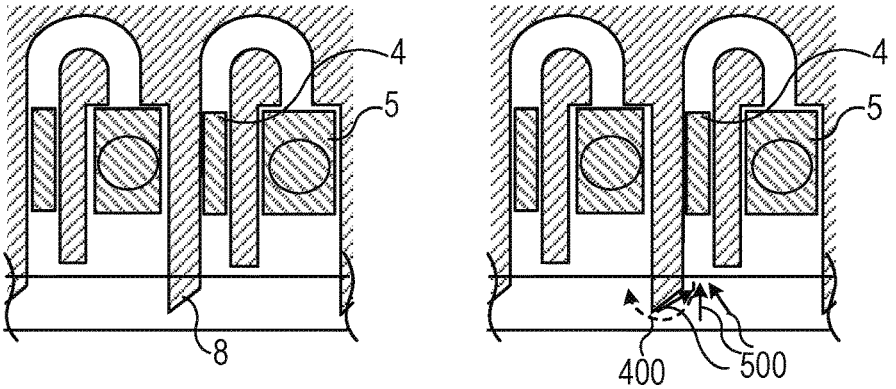

As illustrated in FIG. 2B, a distal end portion of the structure 8 on the first flow path wall 7*a* may have a tapered shape, and the end portion of the distal end portion on the side of the liquid circulating element may be retracted on the side of the liquid circulating element 4 as compared with the end portion on the side of the liquid ejection energy generating element. Since the flowing of the liquid into the liquid circulating element 4 when the liquid is circulated is promoted, it is possible to achieve both the inhibiting of crosstalk and the liquid circulation efficiency. This is because the flow amount (flow 500) of the liquid supplied to the liquid circulating element 4 increases and the flow 400 into another liquid circulation flow path that is adjacent is inhibited, as compared with the case in which the structure 8 illustrated in FIG. 2A is used.

Figure 2C:
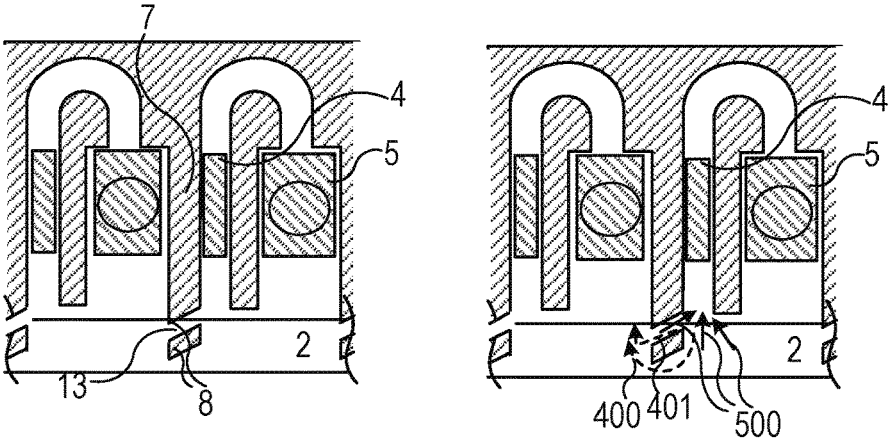

As illustrated in FIG. 2C, the slit 13 may be formed in at least either the flow path wall 7 or the structure 8. Since the flowing of the liquid into the liquid circulating element 4 is promoted when the liquid is circulated, it is possible to enhance liquid circulation efficiency. This is because the flow amount of the liquid supplied to the liquid circulating element 4 increases due to addition of the flow 500 via the slit 13 and the flow 400 into another liquid circulation flow path that is adjacent is inhibited, as compared with the case in which the structure 8 illustrated in FIG. 2A is used. On the other hand, although the flow 401 generated due to influences of crosstalk when the liquid passing through the slit 13 is circulated increases, the flow 500 is further strengthened. Thus, it is possible to achieve both the inhibiting of crosstalk and the liquid circulation efficiency. The slit 13 is adapted such that the end portion of the slit 13 facing the first portion is further retracted as compared with the end portion facing the second portion.

Figure 2D:
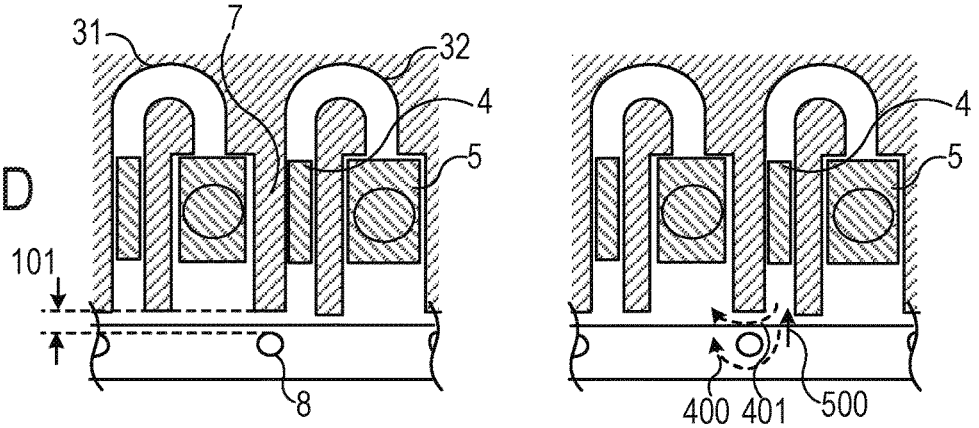

As illustrated in FIG. 2D, the flow path wall 7 and the structure 8 are physically separated in the liquid ejection head according to this embodiment. In this case, a distance 101 between the flow path wall 7 and the structure 8 is preferably shorter than the minimum flow path width of the liquid circulation flow path in order to enhance the crosstalk inhibiting effect, and the flow path wall 7 and the structure 8 are more preferably not separated from each other. It is possible to inhibit the flow 401 generated due to influences of crosstalk when the liquid is circulated. Note that the structure 8 may be a columnar member.

Third Embodiment

Figure 3A:
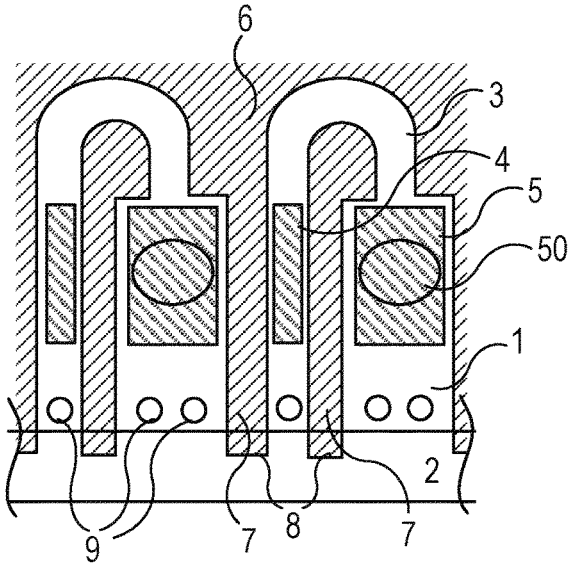
FIGS. 3A, 3B and 3C are diagrams illustrating a third embodiment of a liquid ejection head according to the present disclosure.
Figure 3B:
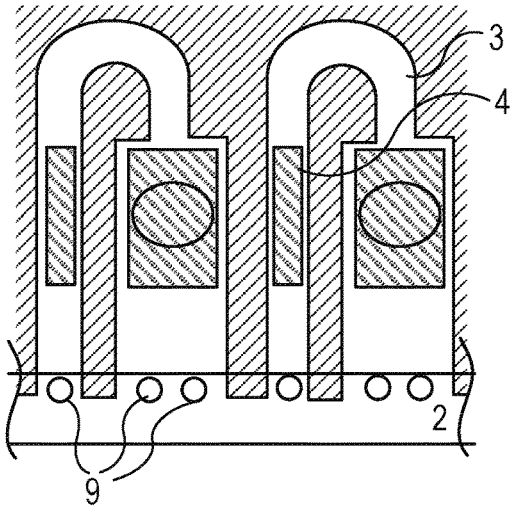
Figure 3C:
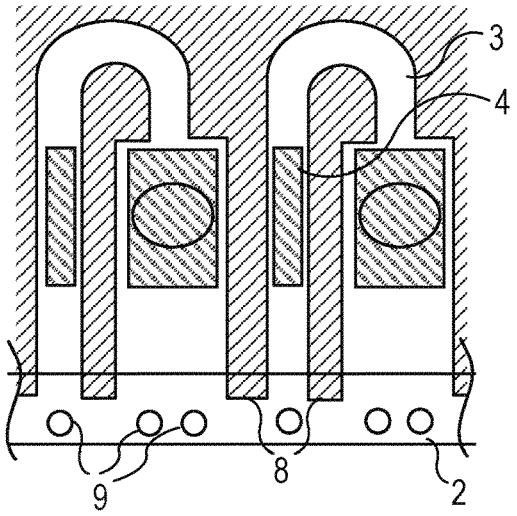

FIGS. 3A to 3C are diagrams illustrating a third embodiment of a liquid ejection head according to the present disclosure. As illustrated in FIG. 3A, a foreign matter foreign matter filter 9 may be combined with the structure 8 in the liquid ejection head according to this embodiment. The foreign matter foreign matter filter 9 is provided at a position near the liquid supply path 2 inside the liquid circulation flow path 3, which corresponds to each of the branched portion and the joined portion between the liquid circulation flow path 3 and the liquid supply path 2. In this manner, it is possible to curb mixing of foreign matters from the liquid supply path 2 into the liquid circulation flow path 3.

As illustrated in FIG. 3B, the liquid ejection head according to this embodiment may be adapted such that the foreign matter foreign matter filter 9 is provided at a position at which the liquid circulation flow path 3 and the liquid supply path 2 overlap each other. Since the flow amount of the liquid supplied from the liquid supply path 2 to the liquid circulating element 4 increases, the liquid circulation efficiency is improved.

As illustrated in FIG. 3C, the liquid ejection head according to this embodiment may be adapted such that the foreign matter foreign matter filter 9 is provided on the side of the liquid supply path 2 as compared with the structure 8. The flow amount of the liquid supplied from the liquid supply path 2 increases, and the liquid circulation efficiency is improved, as compared with the case in which the structure 8 illustrated in FIG. 3B is used. In order to achieve both the liquid circulation efficiency and the inhibiting of propagation to the adjacent flow path, the foreign matter foreign matter filter 9 is preferably not provided.

Fourth Embodiment

Figure 4A:
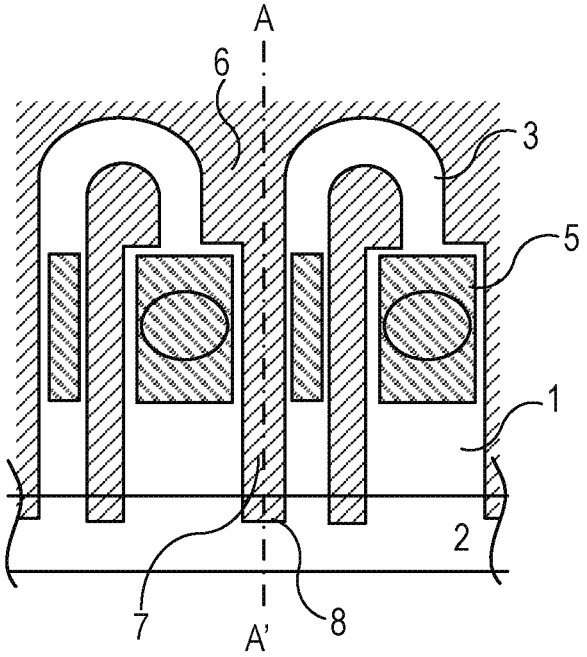
FIGS. 4A and 4B are diagrams illustrating a fourth embodiment of a liquid ejection head according to the present disclosure.
Figure 4B:
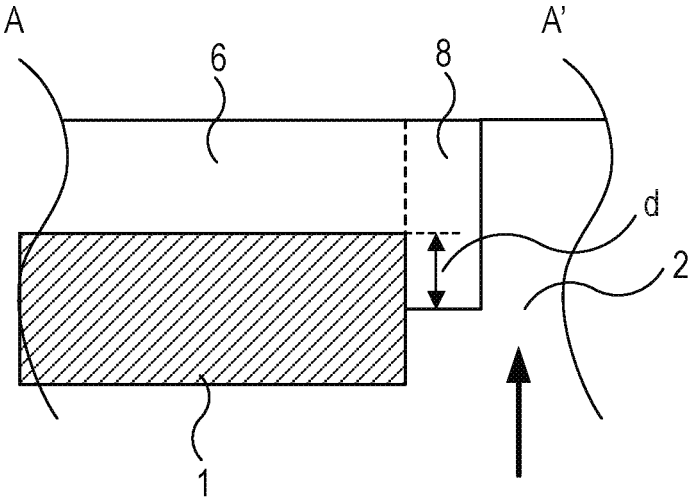

FIGS. 4A and 4B are diagrams illustrating a fourth embodiment of a liquid ejection head according to the present disclosure. This embodiment can be combined with the first embodiment, the second embodiment, and the third embodiment. In this embodiment, the structure 8 is placed so as to enter the substrate 1 in the height direction of the liquid circulation flow path 3. The substrate 1 is provided with a through-holy: that forms the liquid supply path 2, and a part of the structure 8 is provided inside the through-hole. Also, FIG. 4B illustrates the flow path wall member 6 and the structure 8 separately with the dashed line, these are configured of a single member in this embodiment. Since the liquid supply path 2 is partially narrowed, the crosstalk inhibiting effect is enhanced, and further, adhesion between the structure 8 and the substrate 1 is enhanced. The depth by which the structure 8 enters the liquid supply path 2 is preferably not less than the film thickness of the liquid ejection energy generating element 5, a wiring, a protective film, and the like placed on the substrate 1. Also, a depth d by which the structure 8 enters the substrate 1 member is preferably a width by which the structure 8 overlaps the substrate 1 and is further preferably not less than the height of the liquid circulation flow path 3. Here, the height of the liquid circulation flow path 3 is the length of the liquid circulation flow path 3 in the vertical direction of FIG. 4A. Note that the arrow in FIG. 4B indicates the entering direction of the liquid from a liquid storage tank.

Fifth Embodiment

Figure 5:
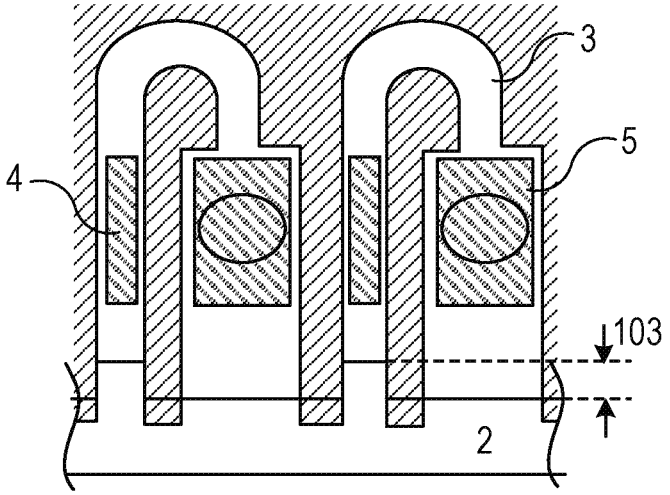
FIG. 5 is a diagram illustrating a fifth embodiment of a liquid ejection head according to the present disclosure.

FIG. 5 is a diagram illustrating a fifth embodiment of a liquid ejection head according to the present disclosure. In this embodiment, a higher effect is achieved by changing the shape of the liquid supply path. This embodiment can be combined with the first embodiment, the second embodiment, and the third embodiment. As illustrated in FIG. 5, the liquid ejection head in the embodiment is adapted such that the liquid supply path 2 is placed so as to partially enter the liquid circulation flow path 3 in the vicinity of the liquid circulating element 4 as compared with the vicinity of the liquid ejection energy generating element 5, Specifically, the width of the liquid supply path 2 is wider at the position facing the first portion than at the position facing the second portion. With such placement, a difference 103 is generated between a boundary between the liquid supply path 2 and the liquid circulation flow path 3 in the front surface of the liquid ejection energy generating element 5 and a boundary between the liquid supply path 2 and the liquid circulation flow path 3 in the front surface of the liquid circulating element 4. In such a form, it is possible to satisfactorily achieve both the inhibiting of crosstalk and the liquid circulation efficiency.

Sixth Embodiment

Figure 6A:
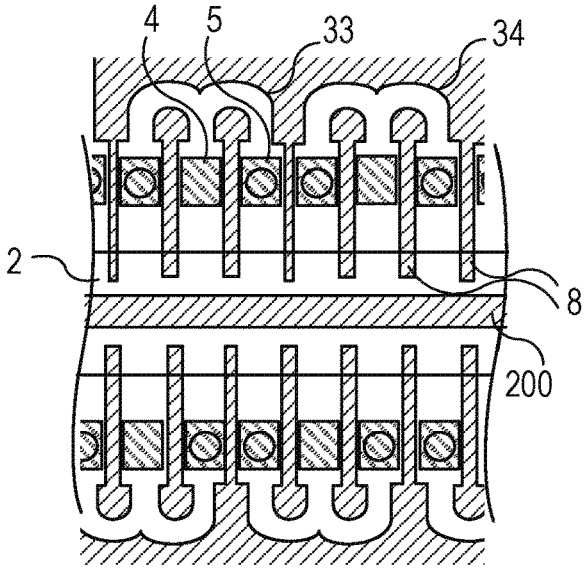
FIGS. 6A, 6B and 6C are diagrams illustrating a sixth embodiment of a liquid ejection head according to the present disclosure.
Figure 6B:
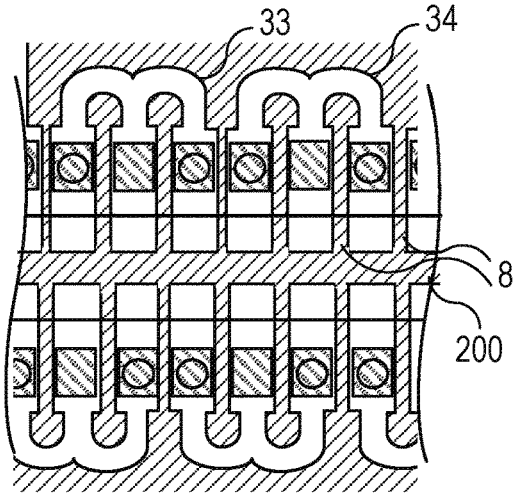
Figure 6C:
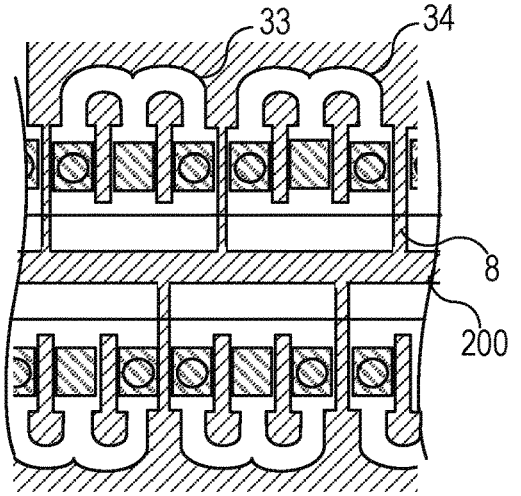

FIGS. 6A to 6C are diagrams illustrating a sixth embodiment of a liquid ejection head according to the present disclosure. FIGS. 6A and 6B are diagrams illustrating combinations with the first embodiment, and FIG. 6C is a diagram illustrating a combination with the second embodiment. In this embodiment, a plurality of liquid circulation flow paths is also placed on the opposite side with the liquid supply path 2 interposed therebetween, which is a direction that perpendicularly intersects the adjacent direction of a liquid circulation flow path 33 and a plurality of liquid circulation flow paths 34 as illustrated in FIG. 6A. Also, partition walls 200 that section the plurality of liquid circulation flow paths and extend in the longitudinal direction of the liquid supply path 2 are placed. In such a form, the structure 8 and each partition wall 200 inhibit crosstalk. Further, as illustrated in FIG. 6B, the crosstalk inhibiting effect is enhanced by the structure 8 extending to the partition wall 200 and the partition wall 200 and the structure 8 being brought into contact with each other. Also, as illustrated in FIG. 6C, the structure 8 that is brought into contact with the partition wall 200 is placed only at the position at which the liquid circulation flow path 33 and the liquid circulation flow path 34 that are adjacent to each other are isolated. In such a form, since the flowing of the liquid into the liquid circulating element 4 is promoted when the liquid is circulated, it is possible to achieve both the inhibiting of crosstalk and the liquid circulation efficiency.

Comparative Examples

Figure 7A:
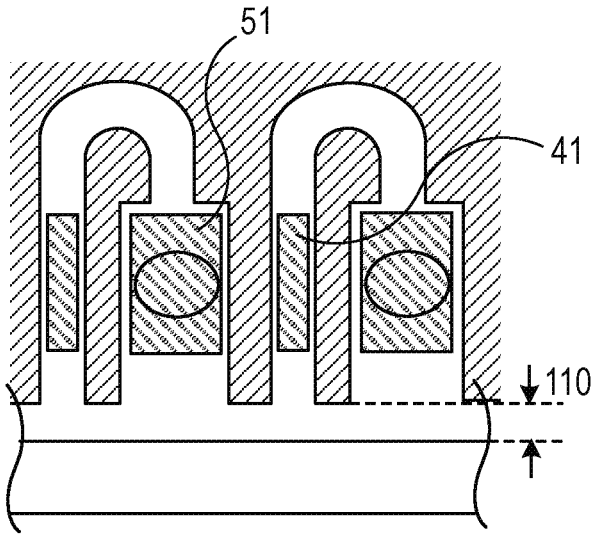
FIGS. 7A and 7B are diagrams illustrating comparative examples.
Figure 7B:
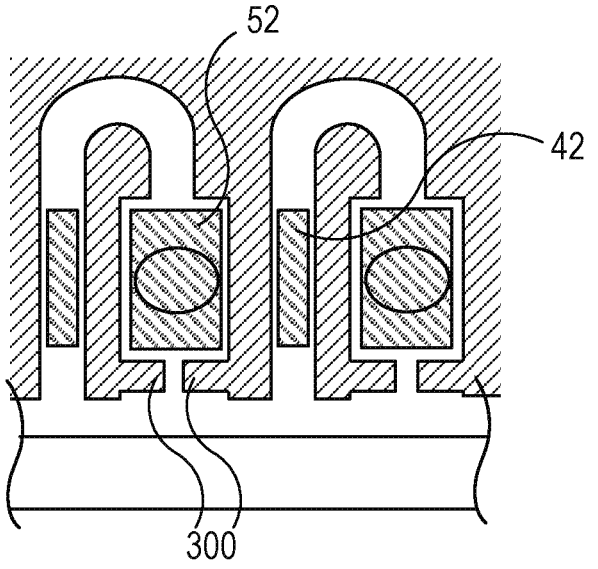

FIGS. 7A and 7B are diagrams illustrating comparative examples. In the liquid ejection head with no structure as illustrated in FIG. 7A, crosstalk at the time of driving occurring between the liquid circulating element 41 and the liquid ejection energy generating element 51 is larger as compared with the liquid ejection head with the structure according to the present disclosure as described above. Thus, providing a crosstalk inhibiting structure 300 as illustrated in FIG. 7B is conceivable. Since such a form restricts the width of the circulation flow path when the density of the circulation flow path is increased although crosstalk occurring between the liquid circulating element 42 and the liquid ejection energy generating element 52 is inhibited, the liquid ejection head according to the present disclosure as described above is more advantageous.

Examples

Although the present disclosure will be more specifically described below by listing examples, the present disclosure is not limited to the examples.

Example 1

As illustrated in FIG. 1A, a liquid ejection head in Example 1 was formed. A substrate (silicon substrate) 1 formed of Si was provided with a liquid supply path 2 penetrating through the substrate 1. Also, the liquid ejection head had a liquid circulation flow path 3, a liquid circulating element 4 and a liquid ejection energy generating element 5 formed of heaters in a route of the liquid circulation flow path 3, and an ejection orifice 50. Further, a circuit (not illustrated) for driving the liquid circulating element 4 and the liquid ejection energy generating element 5 and a protective film (not illustrated) for protecting the substrate and the circuit from the liquid were included. The flow path wall member 6 was made of a photosensitive epoxy resin, and the flow path wall member 6 was used to form the liquid circulation flow path 3, the ejection orifice 50, the flow path wall 7, and the structure 8. The width of the narrowest portion of the liquid circulation flow path 3 was set to 10 μm, the height was set to 20 μm, and the length 100 of the structure 8 was set to 20 μm.

The liquid ejection head in the comparative example illustrated in FIG. 7A was formed as a head for comparison. The head for comparison did not have the structure 8, the distance 110 between the flow path wall and the liquid supply path was set to 20 μm, and the other dimensions were set similarly to those in Example 1. In comparison between the liquid ejection head in Example 1 and the head for comparison, crosstalk was satisfactorily inhibited in the liquid ejection head in Example 1.

Example 2

As illustrated in FIG. 2A, a liquid ejection head in Example 2 was formed. The portions other than the structure 8 were formed similarly to those in the liquid ejection head in Example 1. The width of the narrowest portion of the liquid circulation flow path was set to 10 μm, the height was set to 20 μm, and the length of the structure 8 was set to 20 μm. In comparison between the liquid ejection head in Example 2 and a comparison head, crosstalk was further inhibited in the liquid ejection head in Example 2. Also, in comparison between the liquid ejection head in Example 1 and the liquid ejection head in Example 2, the liquid was more likely flow into the liquid circulating element in the liquid ejection head in Example 2.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of priority from Japanese Patent Application No. 2019-191392, filed Oct. 18, 2019, which is hereby incorporated by reference herein in its entirety.

What is claimed is:

1. A liquid ejection head comprising:

a liquid distribution path through which a liquid is distributed;

a first liquid circulation flow path that is branched from the liquid distribution path and a second liquid circulation flow path that is joined to the liquid distribution path;

a first flow path wall that sections the first liquid circulation flow path and the second liquid circulation flow path;

an ejection orifice, which is provided in the second liquid circulation flow path, from which the liquid is ejected;

an energy generating element that is provided in the second liquid circulation flow path and generates energy for ejecting the liquid from the ejection orifice;

a liquid circulating element that is provided in the first liquid circulation flow path and generates energy for circulating the liquid through the first and second liquid circulation flow paths; and a first extension portion disposed so as to extend along a center line of the first flow path wall and to protrude from the first flow path wall to the liquid distribution path, wherein the first and second liquid circulation flow paths are joined with each other at a position downstream of the liquid circulating element and upstream of energy generating element, and wherein a length by which the first extension portion protrudes is greater than a minimum flow path width of the first liquid circulation flow path.

2. A liquid ejection head comprising:

a liquid distribution path through which a liquid is distributed;

a first liquid circulation flow path that is branched from the liquid distribution path and a second liquid circulation flow path that is joined to the liquid distribution path;

a first flow path wall that sections the first liquid circulation flow path and the second liquid circulation flow path;

an ejection orifice, which is provided in the second liquid circulation flow path, from which the liquid is ejected;

an energy generating element that is provided in the second liquid circulation flow path and generates energy for ejecting the liquid from the ejection orifice;

a liquid circulating element that is provided in the first liquid circulation flow path and generates energy for circulating the liquid through the first and second liquid circulation flow paths; and a first extension portion disposed so as to extend along a center line of the first flow path wall and to protrude from the first flow path wall to the liquid distribution path, wherein the first and second liquid circulation flow paths are joined with each other at a position downstream of the liquid circulating element and upstream of energy generating element, and wherein the first and second liquid circulation flow paths have a first portion provided with the liquid circulating element and a second portion, which is provided with the energy generating element, through which the liquid flows in a direction opposite to the first portion, the liquid ejection head further comprises a second flow path wall that sections the first portion and the second portion, and the second flow path wall has a second extension portion that protrudes to the liquid distribution path.

3. The liquid ejection head according to claim 2, wherein a length by which the first extension portion protrudes is greater than a length by which the second extension portion protrudes.

4. A liquid ejection head comprising:

a liquid distribution path through which a liquid is distributed;

a first liquid circulation flow path that is branched from the liquid distribution path and a second liquid circulation flow path that is joined to the liquid distribution path;

a first flow path wall that sections the first liquid circulation flow path and the second liquid circulation flow path;

an ejection orifice, which is provided in the second liquid circulation flow path, from which the liquid is ejected;

an energy generating element that is provided in the second liquid circulation flow path and generates energy for ejecting the liquid from the ejection orifice;

a liquid circulating element that is provided in the first liquid circulation flow path and generates energy for circulating the liquid through the first and second liquid circulation flow paths; and a structure disposed so as to extend along a center line of the first flow path wall and is at a position at which the structure overlaps the liquid distribution path, wherein the first and second liquid circulation flow paths are joined with each other at a position downstream of the liquid circulating element and upstream of energy generating element, and wherein the first and second liquid circulation flow paths have a first portion provided with the liquid circulating element and a second portion, which is provided with the energy generating element, through which the liquid flows in a direction opposite to the first portion, the liquid ejection head further comprises a second flow path wall that sections the first portion and the second portion and a slit that penetrates through the second flow path wall, and an end portion of the slit that faces the first portion is retracted on a side of the liquid circulating element a distance greater than an end portion facing the second portion.

5. A liquid ejection head comprising:

a liquid distribution path through which a liquid is distributed;

a first liquid circulation flow path that is branched from the liquid distribution path and a second liquid circulation flow path that is joined to the liquid distribution path;

a first flow path wall that sections the first liquid circulation flow path and the second liquid circulation flow path;

an ejection orifice, which is provided in the second liquid circulation flow path, from which the liquid is ejected;

an energy generating element that is provided in the second liquid circulation flow path and generates energy for ejecting the liquid from the ejection orifice;

a liquid circulating element that is provided in the first liquid circulation flow path and generates energy for circulating the liquid through the first and second liquid circulation flow paths; and a first extension portion disposed so as to extend along a center line of the first flow path wall and to protrude from the first flow path wall to the liquid distribution path, wherein the first and second liquid circulation flow paths are joined with each other at a position downstream of the liquid circulating element and upstream of energy generating element, and wherein the first and second liquid circulation flow paths have a first portion provided with the liquid circulating element and a second portion, which is provided with the energy generating element, through which the liquid flows in a direction opposite to the first portion, the liquid ejection head further comprises a second flow path wall that sections the first portion and the second portion, and the second flow path wall has a second extension portion that protrudes to the liquid distribution path, and the first extension portion and the second extension portion are curved in a direction in which the liquid distribution path extends.

6. A liquid ejection head comprising:

a liquid distribution path through which a liquid is distributed;

a first liquid circulation flow path that is branched from the liquid distribution path and a second liquid circulation flow path that is joined to the liquid distribution path;

a first flow path wall that sections the first liquid circulation flow path and the second liquid circulation flow path;

an ejection orifice, which is provided in the second liquid circulation flow path, from which the liquid is ejected;

an energy generating element that is provided in the second liquid circulation flow path and generates energy for ejecting the liquid from the ejection orifice;

a liquid circulating element that is provided in the first liquid circulation flow path and generates energy for circulating the liquid through the first and second liquid circulation flow paths; and a first extension portion disposed so as to extend along a center line of the first flow path wall and to protrude from the first flow path wall to the liquid distribution path, wherein the first and second liquid circulation flow paths are joined with each other at a position downstream of the liquid circulating element and upstream of energy generating element, and wherein the first and second liquid circulation flow paths have a first portion provided with the liquid circulating element and a second portion, which is provided with the energy generating element, through which the liquid flows in a direction opposite to the first portion, a distal end portion of the first extension portion has a tapered shape, and an end portion of the distal end portion on a side of the liquid circulating element is further retracted as compared with an end portion on a side of the energy generating element relative to the liquid distribution path.

7. A liquid ejection head comprising:

a liquid distribution path through which a liquid is distributed;

a first liquid circulation flow path that is branched from the liquid distribution path and a second liquid circulation flow path that is joined to the liquid distribution path;

a first flow path wall that sections the first liquid circulation flow path and the second liquid circulation flow path;

an ejection orifice, which is provided in the second liquid circulation flow path, from which the liquid is ejected;

an energy generating element that is provided in the second liquid circulation flow path and generates energy for ejecting the liquid from the ejection orifice;

a liquid circulating element that is provided in the first liquid circulation flow path and generates energy for circulating the liquid through the first and second liquid circulation flow paths; and a structure disposed so as to extend along a center line of the first flow path wall and is at a position at which the structure overlaps the liquid distribution path, wherein the first and second liquid circulation flow paths are joined with each other at a position downstream of the liquid circulating element and upstream of energy generating element, and wherein the first and second liquid circulation flow paths have a first portion provided with the liquid circulating element and a second portion, which is provided with the energy generating element, through which the liquid flows in a direction opposite to the first portion, the liquid ejection head further comprises a slit that penetrates through the first flow path wall, and an end portion of the slit facing the first portion is further retracted than an end portion facing the second portion relative to the liquid distribution path.

8. A liquid ejection head comprising:

a liquid distribution path through which a liquid is distributed;

a first liquid circulation flow path that is branched from the liquid distribution path and a second liquid circulation flow path that is joined to the liquid distribution path;

a first flow path wall that sections the first liquid circulation flow path and the second liquid circulation flow path;

an ejection orifice, which is provided in the second liquid circulation flow path, from which the liquid is ejected;

an energy generating element that is provided in the second liquid circulation flow path and generates energy for ejecting the liquid from the ejection orifice;

a liquid circulating element that is provided in the first liquid circulation flow path and generates energy for circulating the liquid through the first and second liquid circulation flow paths; and a structure disposed so as to extend along a center line of the first flow path wall and is at a position at which the structure overlaps the liquid distribution path, wherein the first and second liquid circulation flow paths are joined with each other at a position downstream of the liquid circulating element and upstream of energy generating element, and wherein the structure is a columnar member separated from the first flow path wall and positioned in the liquid distribution path, and a distance between the first flow path wall and the columnar member is less than a minimum flow path width of the first liquid circulation flow path.

9. A liquid ejection head comprising:

a liquid distribution path through which a liquid is distributed;

a first liquid circulation flow path that is branched from the liquid distribution path and a second liquid circulation flow path that is joined to the liquid distribution path;

a first flow path wall that sections the first liquid circulation flow path and the second liquid circulation flow path;

an ejection orifice, which is provided in the second liquid circulation flow path, from which the liquid is ejected;

an energy generating element that is provided in the second liquid circulation flow path and generates energy for ejecting the liquid from the ejection orifice;

a liquid circulating element that is provided in the first liquid circulation flow path and generates energy for circulating the liquid through the first and second liquid circulation flow paths; and a structure disposed so as to extend along a center line of the first flow path wall and is at a position at which the structure overlaps the liquid distribution path;

a substrate on which the first flow path wall is provided, wherein the first and second liquid circulation flow paths are joined with each other at a position downstream of the liquid circulating element and upstream of energy generating element, and wherein the substrate has a through-hole forming the liquid distribution path, and a part of the structure is provided inside the through-hole.

10. A liquid ejection head comprising:

a liquid distribution path through which a liquid is distributed;

a first liquid circulation flow path that is branched from the liquid distribution path and a second liquid circulation flow path that is joined to the liquid distribution path;

a first flow path wall that sections the first liquid circulation flow path and the second liquid circulation flow path;

an ejection orifice, which is provided in the second liquid circulation flow path, from which the liquid is ejected;

an energy generating element that is provided in the second liquid circulation flow path and generates energy for ejecting the liquid from the ejection orifice;

a liquid circulating element that is provided in the first liquid circulation flow path and generates energy for circulating the liquid through the first and second liquid circulation flow paths; and a structure disposed so as to extend along a center line of the first flow path wall and is at a position at which the structure overlaps the liquid distribution path;

a plurality of other liquid circulation flow paths provided on an opposite side of the first and second liquid circulation flow paths with the liquid distribution path interposed therebetween; and a partition wall that is provided in the liquid distribution path and sections the first and second liquid circulation flow paths from the plurality of other liquid circulation flow paths, wherein the first and second liquid circulation flow paths are joined with each other at a position downstream of the liquid circulating element and upstream of energy generating element.

11. The liquid ejection head according to claim 10, wherein the structure extends to the partition wall.

* * * * *